US009601056B2

(12) United States Patent
Chung et al.

(10) Patent No.: US 9,601,056 B2
(45) Date of Patent: Mar. 21, 2017

(54) PIXEL AND ORGANIC LIGHT EMITTING DISPLAY DEVICE USING THE SAME

(71) Applicant: Samsung Display Co., Ltd., Gyeonggi-do (KR)

(72) Inventors: Bo-Yong Chung, Yongin (KR); Hai-Jung In, Yongin (KR); Jung-Bae Kim, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 146 days.

(21) Appl. No.: 14/250,742

(22) Filed: Apr. 11, 2014

(65) Prior Publication Data

US 2014/0354517 A1 Dec. 4, 2014

(30) Foreign Application Priority Data

May 29, 2013 (KR) ..... 10-2013-0060869

(51) Int. Cl.
*G09G 3/32* (2016.01)

(52) U.S. Cl.
CPC ..... *G09G 3/3258* (2013.01); *G09G 3/3233* (2013.01); *G09G 2300/0852* (2013.01); *G09G 2300/0861* (2013.01)

(58) Field of Classification Search
CPC ..... G09G 3/3233; G09G 3/3258
See application file for complete search history.

(56) References Cited

U.S. PATENT DOCUMENTS

2005/0017934 A1 1/2005 Chung et al.
2005/0280616 A1* 12/2005 Miwa ..... G09G 3/3233 345/77
2011/0199357 A1* 8/2011 Chung ..... G09G 3/3233 345/211
2012/0038605 A1* 2/2012 Han ..... H05B 33/0896 345/211
2012/0113077 A1 5/2012 Kang
2012/0146999 A1* 6/2012 Hwang ..... G09G 3/003 345/419
2013/0100173 A1* 4/2013 Chaji ..... G09G 5/10 345/690
2014/0192037 A1* 7/2014 Chung ..... G09G 3/2022 345/212

FOREIGN PATENT DOCUMENTS

KR 10-2005-0005646 1/2005
KR 10-2012-0048294 5/2012

* cited by examiner

*Primary Examiner* — Alexander Eisen
*Assistant Examiner* — Kebede Teshome
(74) *Attorney, Agent, or Firm* — Lee & Morse, P.C.

(57) ABSTRACT

A pixel includes an organic light emitting diode (OLED) having a cathode electrode coupled to a second power supply, a pixel circuit configured to control an amount of current supplied to the OLED to correspond to a previous data signal, and a driver configured to store a present data signal supplied from a data line and to supply the previous data signal to the pixel circuit. The OLED, pixel circuit, and driver may be controlled by signals in a frame that includes first through fourth periods, the second power supply may be set to a first voltage in the first and second periods and to a second voltage in the third and fourth periods, and the first voltage may be a voltage at which the OLED does not emit light and the second voltage may be a voltage at which the OLED emits light.

27 Claims, 6 Drawing Sheets

PIXEL AND ORGANIC LIGHT EMITTING DISPLAY DEVICE USING THE SAME

CROSS-REFERENCE TO RELATED APPLICATION

Korean Patent Application No. 10-2013-0060869, filed on May 29, 2013, and entitled, "Pixel and Organic Light Emitting Display Device Using the Same," is incorporated by reference herein in its entirety.

BACKGROUND

1. Field

One or more embodiments described herein relate to a display device.

2. Description of the Related Art

An organic light emitting display device displays images using organic light emitting diodes (OLED) that generate light based on a re-combination of electrons and holes in an active layer. An organic light emitting display device may have a high response speed and may be driven with low power consumption.

SUMMARY

Embodiments are directed to a pixel, including an organic light emitting diode (OLED) having a cathode electrode coupled to a second power supply, a pixel circuit configured to control an amount of current supplied to the OLED to correspond to a previous data signal, and a driver configured to store a present data signal supplied from a data line and to supply the previous data signal to the pixel circuit. The OLED, pixel circuit, and driver may be controlled by signals in a frame that includes first through fourth periods, the second power supply may be set to a first voltage in the first and second periods and to a second voltage in the third and fourth periods, and the first voltage may be a voltage at which the OLED does not emit light and the second voltage may be a voltage at which the OLED emits light.

In the fourth period, a current may be supplied from the pixel circuit to the OLED, and the present data signal may be charged in the driver.

The pixel circuit may include a first transistor having a gate electrode coupled to a first node, a first electrode coupled to a first power supply via a third node, and a second electrode coupled to an anode electrode of the OLED, a third transistor coupled between a data line and a second node, the third transistor turning on when a first control signal is supplied to a first control line, a second transistor coupled between the first node and the second node, the second transistor turning off when an emission control signal is supplied to an emission control line, a first capacitor coupled between the second node and the third node, and a fourth transistor coupled between the first power supply and the third node, the fourth transistor turning off when the emission control signal is supplied.

The third transistor may be turned on in the first period to the third period, and the second transistor may be turned off in the second period and the third period.

The pixel may further include a seventh transistor coupled between the anode electrode of the OLED and an initializing power supply, the seventh transistor turning on when a second control signal is supplied to a second control line.

The seventh transistor may be turned on in the second period and the third period.

A voltage of the initializing power supply may be set so that a current supplied, via the first transistor, flows when the seventh transistor is turned on.

The initializing power supply may be the second power supply.

The third transistor may be turned on in the first period and the second period, and the second transistor may be turned off in the second period and the third period.

The third transistor may be turned off before the second power supply at the second voltage is supplied.

The driver may include a fifth transistor coupled between the data line and a fourth node, the fifth transistor turning on when a scan signal is supplied to a scan line, sixth transistor coupled between the fourth node and the first node, the sixth transistor turning on when a second control signal is supplied to a second control line, and a second capacitor coupled between the fourth node and an initializing power supply.

The fifth transistor may be turned on at a predetermined point within the fourth period, and the sixth transistor may be turned on in the second period and the third period.

The first voltage may be greater than the second voltage.

Embodiments are also directed to an organic light emitting display device, including a second power supply unit configured to supply a first voltage in a first period and a second period of one frame and to supply a second voltage in a third period and a fourth period of one frame, a control driver configured to supply a first control signal to a first control line in the first period and the second period and to supply a second control signal to a second control line in the second period and the third period, a scan driver configured to sequentially supply scan signals to scan lines in the fourth period and to supply an emission control signal to an emission control line in the second period and the third period, a data driver configured to supply a bias voltage to data lines in the first period, to supply a reference voltage in the second period and the third period, and to supply data signals in the fourth period, and pixels configured to store present data signals and to emit light to correspond to previous data signals in the fourth period.

The previous data signals may be data signals of a previous frame, and the present data signals may be data signals of a present frame.

The bias voltage may be an off-bias voltage at which driving transistors included in the pixels can be turned off.

The reference voltage may be a voltage within a voltage range of the data signals.

Each pixel may include an OLED having a cathode electrode coupled to the second power supply, a pixel circuit configured to control an amount of current supplied to the OLED to correspond to the previous data signal, and a driver configured to store the present data signal and to supply the previous data signal to the pixel circuit.

The pixel circuit may include a first transistor having a gate electrode coupled to a first node, a first electrode coupled to a first power supply via a third node, and a second electrode coupled to an anode electrode of the OLED, a third transistor coupled between a data line and a second node, the third transistor turning on when the first control signal is supplied, a second transistor coupled between the first node and the second node, the second transistor turning off when the emission control signal is supplied, a first capacitor coupled between the first node and the third node, and a fourth transistor coupled between the second power supply and the third node, the fourth transistor turning off when the emission control signal is supplied.

The control driver may supply the first control signal to the first control line in the third period.

The display device may further include a seventh transistor coupled between the anode electrode of the OLED and an initializing power supply, the seventh transistor turning on when the second control signal is supplied.

A voltage of the initializing power supply may be set so that a current supplied, via the first transistor, flows when the seventh transistor is turned on.

The initializing power supply may be the second power supply.

The driver may include a fifth transistor coupled between a data line and a fourth node, the fifth transistor turning on when a scan signal is supplied to a corresponding scan line, a sixth transistor coupled between the fourth node and the first node, the sixth transistor turned on when the second control signal is supplied, and a second capacitor coupled between the fourth node and an initializing power supply.

The first voltage may be greater than the second voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
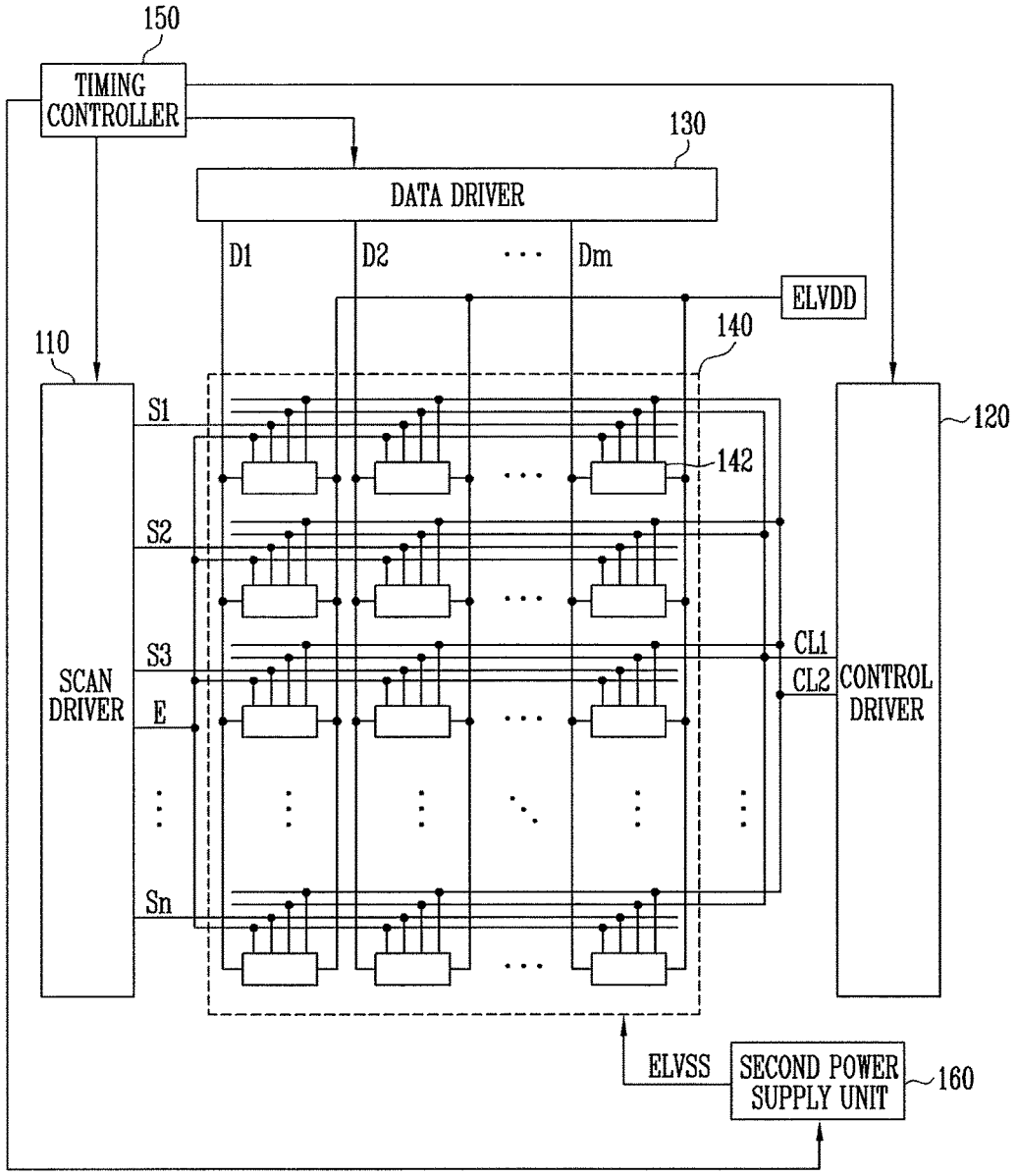
FIG. 1 illustrates an embodiment of an organic light emitting display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawing figures, the dimensions of layers and regions may be exaggerated for clarity of illustration. Like reference numerals refer to like elements throughout.

FIG. 1 illustrates an embodiment of an organic light emitting display device which includes a pixel unit 140 including pixels 142 positioned in regions partitioned by scan lines S1 to Sn and data lines D1 to Dm, a scan driver 110 configured to drive the scan lines S1 to Sn and an emission control line E, a control driver 120 configured to drive a first control line CL1 and a second control line CL2, a data driver 130 configured to drive the data lines D1 to Dm, a second power supply unit 160 configured to generate a second power supply ELVSS, and a timing controller 150 configured to control the drivers 110, 120, and 130 and the second power supply unit 160.

Figure 3:
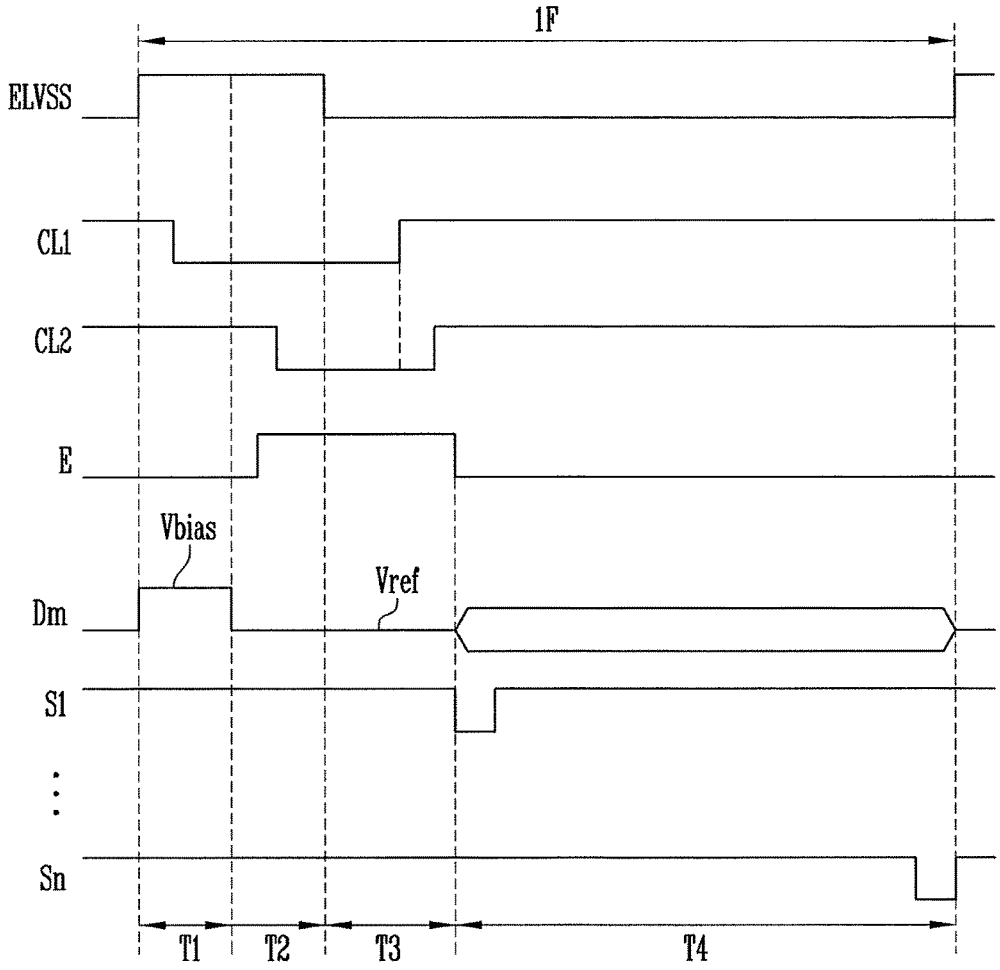
FIG. 3 is a waveform diagram corresponding to one embodiment of a method for driving a pixel.

The scan driver 110 supplies scan signals to the scan lines S1 to Sn. For example, the scan driver 110 may sequentially supply the scan signals to the scan lines S1 to Sn in a fourth period T4 of one frame 1F as illustrated in FIG. 3. In addition, the scan driver 110 supplies an emission control signal to the emission control line E commonly coupled to the pixels 142. For example, the scan driver 110 may supply the emission control signal to the emission control line E in a second period T2 and a third period T3 of the frame 1F. The scan signals are set to have voltages (for example, low voltages) at which transistors included in the pixels 142 may be turned on, and the emission control signal is set to have a voltage (for example, a high voltage) at which transistors included in the pixels 142 may be turned off.

The control driver 120 supplies a first control signal to the first control line CL1 commonly coupled to the pixels 142 and supplies a second control signal to the second control line CL2. For example, the control driver 120 may supply the first control signal in a first period T1 to the third period T3 of the frame 1F and may supply the second control signal in the second period T2 and the third period T3.

The data driver 130 supplies the data signals to the data lines D1 to Dm in synchronization with the scan signals supplied to the scan lines S1 to Sn in the fourth period T4. The data driver 130 supplies a bias voltage Vbias to the data lines D1 to Dm in the first period T1 and supplies a reference voltage Vref to the data lines D1 to Dm in the second period T2 and the third period T3. The bias voltage Vbias is set as a voltage (on bias) at which driving transistors included in the pixels 142 may be turned on or a voltage (off bias) at which the driving transistors included in the pixels 142 may be turned off. The reference voltage Vref is set as a specific voltage within a voltage range of the data signals.

The second power supply unit 160 supplies a high second power supply ELVSS in the first period T1 and the second period T2 and supplies a low second power supply ELVSS in the third period T3 and the fourth period T4. The high second power supply ELVSS is set to have a high voltage so that currents do not flow from organic light emitting diodes (OLED) included in the pixels 142, and the low second power supply ELVSS is set to have a low voltage so that currents may flow from the OLEDs.

The timing controller 150 controls the scan driver 110, the control driver 120, the data driver 130, and the second power supply unit 160 to correspond to synchronizing signals supplied from an external source.

The pixel unit 140 includes the pixels 142 positioned in regions corresponding to the scan lines S1 to Sn and the data lines D1 to Dm. The pixels 142 charge present data signals and generate light components with predetermined brightness components to correspond to previous data signals in the fourth period T4. The pixels 142 emit light while controlling amounts of currents that flow from a first power supply ELVDD to the second power supply ELVSS, via the OLEDs, to correspond to the previous data signals in the fourth period T4.

In FIG. 1, the emission control line E is coupled to the scan driver 110 and the control lines CL1 and CL2 are coupled to the control driver 120. In other embodiments, the emission control line E and the control lines CL1 and CL2 may be coupled to various drivers configured to supply the waveforms described herein. For example, the emission control line E and the control lines CL1 and CL2 may be coupled to the scan driver 110.

Figure 2:
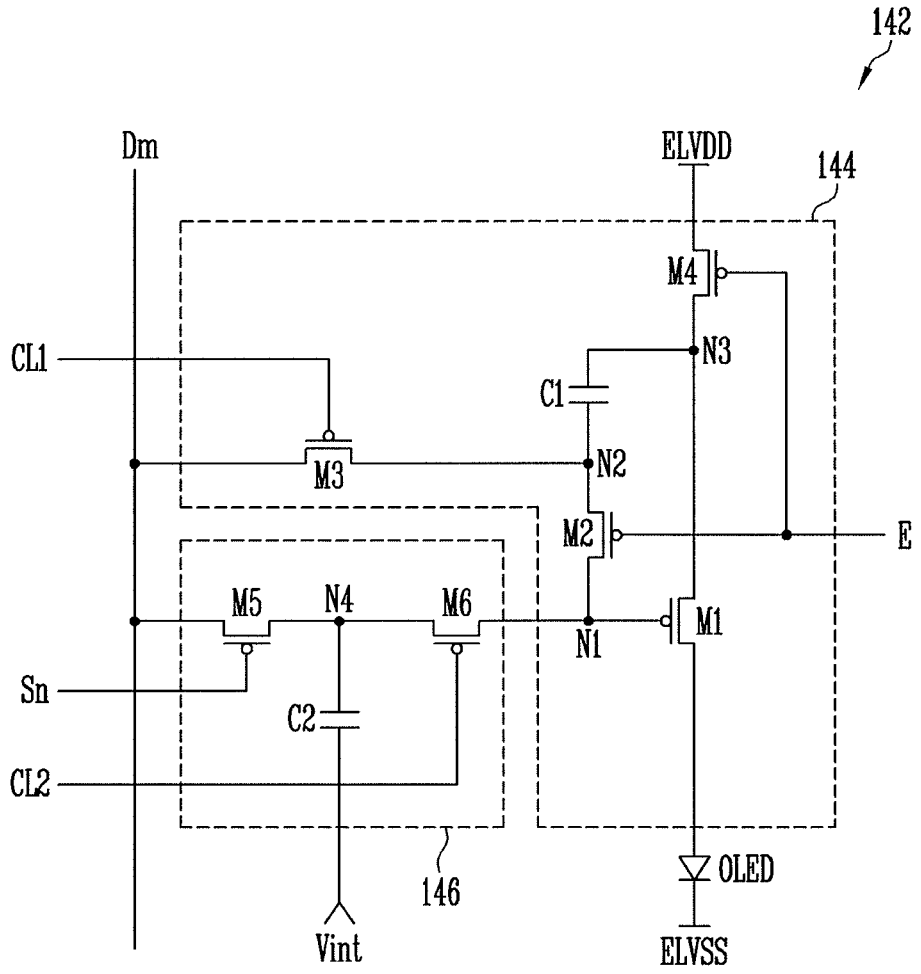
FIG. 2 illustrates a first embodiment of a pixel in FIG. 1.

FIG. 2 illustrates a first embodiment of a pixel which, for example, may be representative of the pixels illustrated in FIG. 1. In FIG. 2, for convenience sake, a pixel coupled to the nth scan line Sn and the mth data line Dm is illustrated.

Referring to FIG. 2, a pixel 142 includes an organic light emitting diode (OLED), a pixel circuit 144 configured to control an amount of current supplied to the OLED to correspond to a previous data signal, and a driver 146 configured to store a present data signal. The previous data signal may correspond to a data signal supplied in a previous frame and a present data signal may correspond to a data signal supplied in a present frame.

An anode electrode of the OLED is coupled to the pixel circuit 144 and a cathode electrode of the OLED is coupled to the second power supply ELVSS. The OLED generates light with predetermined brightness to correspond to the amount of current supplied from the pixel circuit 144. For this purpose, the second power supply ELVSS is set to have a lower voltage than that of the first power supply ELVDD.

The pixel circuit 144 controls the amount of current supplied to the OLED to correspond to the previous data signal. For this purpose, the pixel circuit 144 includes first to fourth transistors M1 to M4 and a first capacitor C1.

A first electrode of the first transistor M1 (Thus, a driving transistor) is coupled to a third node N3 and a second electrode of the first transistor M1 is coupled to the anode electrode of the OLED. A gate electrode of the first transistor M1 is coupled to a first node N1. The first transistor M1 controls the amount of current supplied to the OLED to correspond to a voltage applied to the first node N1.

A first electrode of the second transistor M2 is coupled to a second node N2 and a second electrode of the second transistor M2 is coupled to the first node N1. A gate electrode of the second transistor M2 is coupled to the emission control line E. The second transistor. M2 is turned off when an emission control signal is supplied to the emission control line E and is turned on when the emission control signal is not supplied. When the second transistor M2 is turned on, the second node N2 and the first node N1 are electrically coupled to each other.

A first electrode of the third transistor M3 is coupled to the data line Dm and a second electrode of the third transistor M3 is coupled to the second node N2. A gate electrode of the third transistor M3 is coupled to the first control line CL1. The third transistor M3 is turned on when the first control signal is supplied to the first control line CL1 to electrically couple the data line Dm and the second node N2.

A first electrode of the fourth transistor M4 is coupled to the first power supply ELVDD and a second electrode of the fourth transistor M4 is coupled to the third node N3. A gate electrode of the fourth transistor M4 is coupled to the emission control line E. The fourth transistor M4 is turned off when the emission control signal is supplied to the emission control line E and is turned on when the emission control signal is not supplied. When the fourth transistor M4 is turned on, the voltage of the first power supply ELVDD is supplied to the third node N3.

The first capacitor C1 is coupled between the second node N2 and the third node N3. The first capacitor C1 charges to a voltage corresponding to the previous data signal supplied from the driver 146 and a threshold voltage of the first transistor M1. On the other hand, the first capacitor C1 is not charged by a charge sharing method with a second capacitor C2 included in the driver 146. Thus, in a period where a voltage of a data signal is supplied from the second capacitor C2 to the first node N1, the first capacitor C1 is electrically insulated from the first node N1.

The driver 146 stores the present data signal supplied from the data line Dm and supplies the previous data signal stored in the previous frame to the pixel circuit 144. For this purpose, the driver 146 includes a fifth transistor M5, a sixth transistor M6, and the second capacitor C2.

A first electrode of the fifth transistor M5 is coupled to the data line Dm and a second electrode of the fifth transistor M5 is coupled to a fourth node N4. A gate electrode of the fifth transistor M5 is coupled to the scan line Sn. The fifth transistor M5 is turned on when the scan signal is supplied to the scan line Sn to supply the data signal from the data line Dm to the fourth node N4.

A first electrode of the sixth transistor M6 is coupled to the fourth node N4 and a second electrode of the sixth transistor M6 is coupled to the first node N1. A gate electrode of the sixth transistor M6 is coupled to the second control line CL2. The sixth transistor M6 is turned on when the second control signal is supplied to the second control line CL2 to electrically couple the fourth node N4 and the first node N1.

The second capacitor C2 is coupled between the fourth node N4 and a fixed voltage supply (for example, an initializing power supply Vint). The second capacitor C2 charges to a voltage corresponding to the present data signal in a period where the fifth transistor M5 is turned on.

According to one embodiment, the first capacitor C1 is not charged by a charge sharing method with the second capacitor C2. In this case, the second capacitor C2 may be set to have a capacitance similar to or the same as the first capacitor C1. When the first capacitor C1 is charged by the charge sharing method, the second capacitor C2 is set to have a capacitance (for example, no less than five times) higher than that of the first capacitor C1, so that a layout area is increased.

FIG. 3 illustrates a waveform corresponding to a first embodiment of a method for driving a pixel, which, for example, may be the pixel shown in FIG. 2. Referring to FIG. 3, the pixel may be drive by a plurality of frames, one frame 1F of which may be divided into four periods, namely a first period T1, a second period T2, a third period T3, and a fourth period T4.

In the first period T1, the bias voltage Vbias is applied to the first transistor M1. In the second period T2 and the third period T3, the voltage corresponding to the previous data signal and the threshold voltage of the first transistor M1 is charged in the pixel circuit 144. In the fourth period T4, the voltage corresponding to the present data signal is charged in the driver 146 and the OLED emits light. The operation process will be described in detail below.

First, in the first period T1 and the second period T2, the high second power supply ELVSS is supplied so that the OLED is set in a non-emission state. In the first period T1, the first control signal is supplied to the first control line CL1 and the bias voltage Vbias is supplied to the data line Dm.

When the first control signal is supplied to the first control line CL1, the third transistor M3 is turned on. When the third transistor M3 is turned on, the bias voltage Vbias from the data line Dm is supplied to the second node N2. At this time, since the emission control signal is not supplied to the emission control line E, the bias voltage Vbias supplied to the second node N2 is supplied to the first node N1 via the second transistor M2.

When the bias voltage Vbias is supplied to the first node N1, the first transistor M1 is initialized to an on-bias state or an off-bias state to correspond to the bias voltage Vbias. For example, when an off-bias voltage Vbias is supplied in the first period T1, the first transistor M1 is set in the off-bias state, so that a voltage characteristic curve of the first transistor M1 is initialized to the off-bias state.

In the second period T2 and the third period T3, the emission control signal is supplied to the emission control line E. When the emission control signal is supplied to the emission control line E, the second transistor M2 and the fourth transistor M4 are turned off. When the second transistor M2 is turned off, the first node N1 and the second node N2 are electrically insulated from each other. When the fourth transistor M4 is turned off, the first power supply ELVDD and the third node N3 are electrically insulated from each other.

In addition, in the second period T2, supply of the first control signal is maintained and the second control signal is supplied to the second control line CL2. When the second control signal is supplied to the second control line CL2, the sixth transistor M6 is turned on. When the sixth transistor M6 is turned on, the voltage of the previous data signal stored in the second capacitor C2 is supplied to the first node N1. At this time, since the second transistor M2 is set in a turn-off state, the first capacitor C1 and the second capacitor C2 are electrically insulated from each other.

Then, in the third period T3, the levels of the first control signal, the second control signal, and the emission control signal are maintained and a low second power supply ELVSS is supplied to the cathode electrode of the OLED. When the low second power supply ELVSS is supplied, a current flows from the first transistor M1 to the second power supply ELVSS, via the OLED, to correspond to the previous data signal supplied to the first node N1. At this time, the third node N3 is reduced to a voltage corresponding to the sum of the voltage of the previous data signal and an absolute value threshold voltage of the first transistor M1.

Thus, in the third period T3, the voltage of the previous data signal Vdata is applied to the first node N1, the reference voltage Vref is applied to the second node N2, and the voltage corresponding to the sum of the voltage of the previous data signal and the absolute value threshold voltage of the first transistor M1, Vdata+|Vth|, is applied to the third node N3. Therefore, in the third period T3, a voltage corresponding to a subtraction between a voltage of the second node N2 and a voltage of the third node N3 is charged in the first capacitor C1. On the other hand, the voltage of the reference power supply Vref is set as the specific voltage within the voltage range of the data signals. Therefore, when voltages of the data signals are controlled to be higher or lower than the reference voltage Vref, predetermined gray scale values may be realized.

In the fourth period T4, the supplies of the emission control signal, the first control signal, and the second control signal are stopped. When the supply of the first control signal to the first control line CL1 is stopped, the third transistor M3 is turned off. When the supply of the second control signal to the second control line CL2 is stopped, the sixth transistor M6 is turned off. When the supply of the emission control signal to the emission control line E is stopped, the fourth transistor M4 and the second transistor M2 are turned on.

When the fourth transistor M4 is turned on, the voltage of the first power supply ELVDD is supplied to the third node N3. When the second transistor M2 is turned on, the second node N2 and the first node N1 are electrically coupled. In this case, the voltage of the first node N1 is set as the voltage of the reference power supply Vref.

Therefore, in the fourth period T4, the voltage of the first transistor M1 is set as Vsg=Vdata−Vref+|Vth|. Here, since the reference voltage Vref is a fixed voltage, an amount of current that flows through the first transistor M1 is determined by the data signal. Thus, in the fourth period T4, the first transistor M1 controls the amount of current that flows from the first power supply ELVDD to the low second power supply ELVSS, via the OLED, to correspond to the voltage Vsg of the first transistor M1.

On the other hand, in the fourth period T4, the scan signals are sequentially supplied to the scan lines S1 to Sn. When the scan signal is supplied to the nth scan line Sn, the fifth transistor M5 is turned on. When the fifth transistor M5 is turned on, the present data signal supplied to the data line Dm is stored in the second capacitor C2.

According to one embodiment, the above-described processes are repeated so that predetermined gray scale values are realized. Also according to one embodiment, the first capacitor C1 is not electrically coupled to the second capacitor C2 in a period where the first capacitor C1 is charged, so that the capacitance of the second capacitor C2 may be reduced or minimized. Furthermore, according to one embodiment, the pixels 142 simultaneously compensate for the threshold voltage of the first transistor M1, so that it may be possible to secure a sufficient period of compensating for the threshold voltage and to improve display quality.

Figure 4:
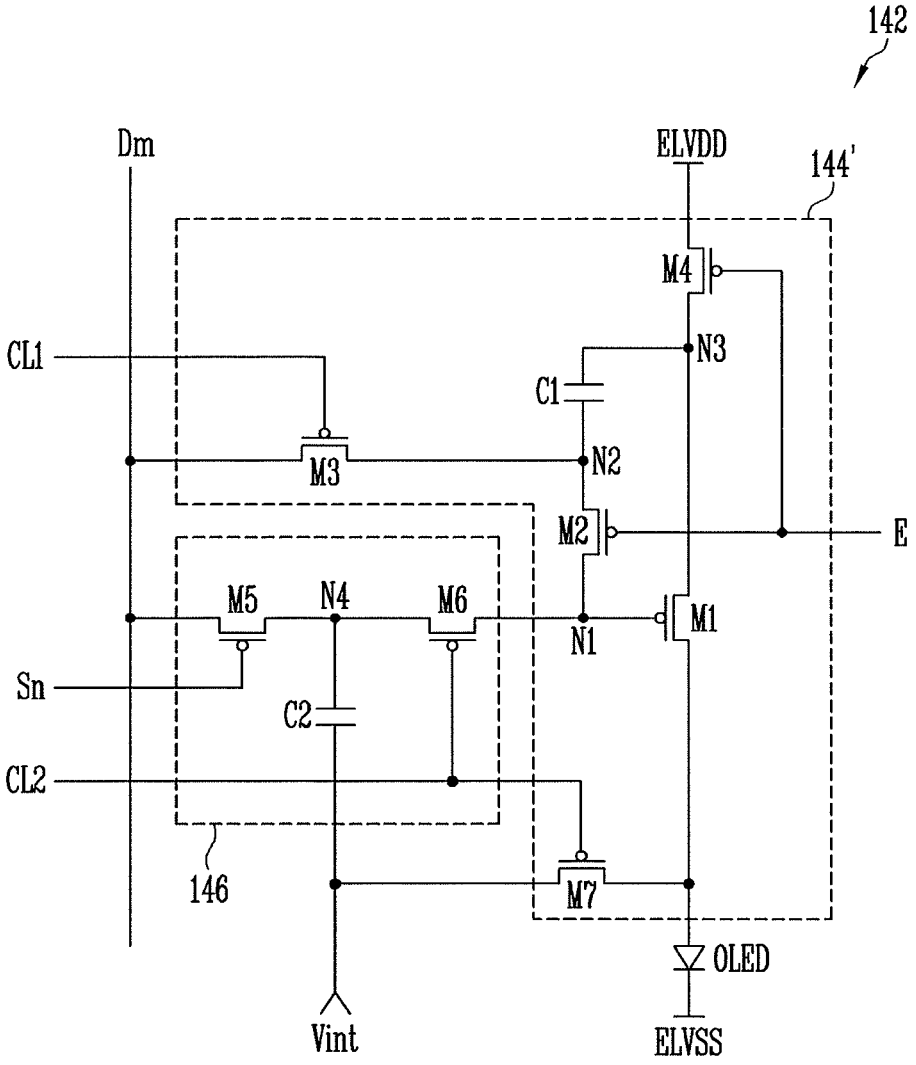
FIG. 4 illustrates a second embodiment of a pixel in FIG. 1.

FIG. 4 illustrates a second embodiment of a pixel 142, which, for example, may be representative of the pixels illustrated in FIG. 1. Referring to FIG. 4, pixel 142 includes an OLED, a pixel circuit 144', and a driver 146.

The pixel circuit 144' includes a seventh transistor M7 coupled between an initializing power supply Vint and an anode electrode of the OLED. The seventh transistor M7 is turned on when the second control signal is supplied to the second control line CL2, to electrically couple the initializing power supply Vint and the anode electrode of the OLED.

Thus, the seventh transistor M7 is turned on when the second control signal is supplied to the second control line CL2, to supply a current supplied from the first transistor M1 to the initializing power supply Vint. For this purpose, the voltage of the initializing power supply Vint is set so that the current supplied via the first transistor M1 may flow in a period where the seventh transistor M7 is turned on.

A structure and operation processes of the pixel 142 according to the second embodiment are the same as those of the pixel according to the first embodiment illustrated in FIG. 2, except that the current from the first transistor M1 is supplied to the initializing power supply Vint using the seventh transistor M7 in the second period T2 and the third period T3. Additionally, the pixel 142 according to the second embodiment may be driven by the driving waveforms of the first embodiment illustrated in FIG. 3 or driving waveforms of a second embodiment illustrated in FIG. 5.

Figure 5:
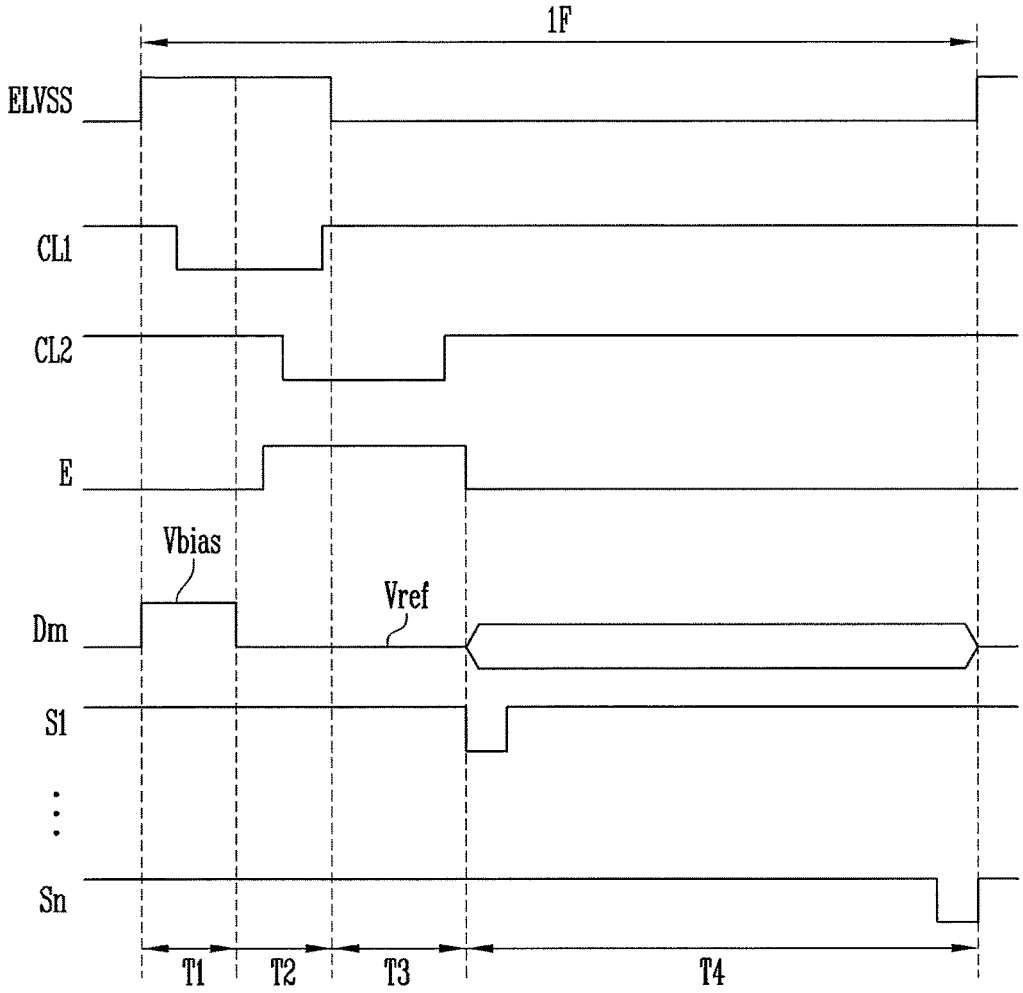
FIG. 5 illustrate driving waveforms corresponding to a second embodiment a method for driving a pixel.

FIG. 5 illustrates driving waveforms corresponding to a second embodiment of a method for driving a pixel. Referring to FIG. 5, the first control signal is supplied to the first control line CL1 in the first period T1 and the second period T2. The supply of the first control signal is stopped after the second control signal is supplied before the low second power supply ELVSS is supplied.

In the driving waveforms of the first embodiment illustrated in FIG. 3, the supply of the first control signal is stopped in a period where the low second power supply ELVSS is supplied. In the driving waveforms of the second embodiment, the supply of the first control signal is stopped before the low second power supply ELVSS is supplied.

When the operation processes are described with reference to FIGS. 4 and 5, the high second power supply ELVSS is supplied in the first period T1 and the second period T2 of the one frame 1F, so that the OLED is set in the non-emission state.

In the first period T1, the first control signal is supplied to the first control line CL1 and the bias voltage Vbias is supplied to the data line Dm. When the first control signal is supplied, the third transistor M3 is turned on so that the bias voltage Vbias from the data line Dm is supplied to the first node N1 via the second node N2 and the second transistor M2. When the bias voltage Vbias is supplied to the first node N1, the first transistor M1 is initialized to the on-bias state or the off-bias state to correspond to the bias voltage Vbias.

In the second period T2 and the third period T3, the emission control signal is supplied to the emission control line E, so that the second transistor M2 and the fourth transistor M4 are turned off. In part of the second period T2, the first control signal is supplied and the second control signal is supplied to the second control line CL2.

When the second control signal is supplied to the second control line CL2, the sixth transistor M6 and the seventh transistor M7 are turned on.

When the seventh transistor M7 is turned on, the initializing power supply Vint and the anode electrode of the OLED are electrically coupled. In this case, the current from the first transistor M1 is supplied to the initializing power supply Vint via the seventh transistor M7.

When the sixth transistor M6 is turned on, the voltage of the previous data signal stored in the second capacitor C2 is supplied to the first node N1. At this time, since the second transistor M2 is set in the turn-off state, the first capacitor C1 and the second capacitor c2 are electrically insulated from each other.

When the voltage of the previous data signal is supplied to the first node N1, the voltage of the third node N3 is reduced from the voltage of the first power supply ELVDD to the voltage corresponding to the sum of the voltage of the previous data signal and the absolute value threshold voltage of the first transistor M1. Thus, in the second period T2, the voltage of the previous data signal Vdata is applied to the first node N1, the reference voltage Vref is applied to the second node N2, and the voltage corresponding to the sum of the voltage of the previous data signal and the absolute value threshold voltage of the first transistor M1, Vdata+|Vth|, is applied to the third node N3. Therefore, in the second period T2, a voltage corresponding to a subtraction between a voltage of the second node N2 and a voltage of the third node N3 is charged in the first capacitor C1.

After a desired voltage is applied to the third node N3, the supply of the first control signal to the first control line CL1 is stopped. When the supply of the first control signal to the first control line CL1 is stopped, the third transistor M3 is turned off. When the third transistor M3 is turned off, the second node N2 is set in a floating state. When the second node N2 is set in the floating state, regardless of a change in the voltage of the third node N3, the first capacitor C1 maintains a voltage charged in a previous period.

In the third period T3, the supplies of the second control signal and the emission control signal are maintained and the low second power supply ELVSS is supplied to the cathode electrode of the OLED. Here, due to the change (high→low) in a voltage of the second power supply ELVSS, the voltage of the third node N3 may be swung. However, since the second node N2 is maintained in the floating state, the first capacitor C1 may stably maintain a charged voltage. Thus, in the driving method according to the second embodiment, the second power supply ELVSS may be maintained in a high voltage in a period where the threshold voltage is compensated for and the second power supply ELVSS may be changed to a low voltage after the threshold voltage is compensated for. In this case, the threshold voltage of the first transistor M1 may be stably compensated for despite the change in the voltage of the second power supply ELVSS.

In the fourth period T4, the supplies of the emission control signal, the first control signal, and the second control signal are stopped. In this case, the first transistor M1 controls the amount of current that flows from the first power supply ELVDD to the low second power supply ELVSS, via the OLED, to correspond to the voltage Vsg=(Vdata−Vref+|Vth|).

In the fourth period T4, the scan signals are sequentially supplied to the scan lines S1 to Sn. When the scan signal is supplied to the nth scan line Sn, the fifth transistor M5 is turned on. When the fifth transistor M5 is turned on, the present data signal supplied to the data line Dm is stored in the second capacitor C2.

Figure 6:
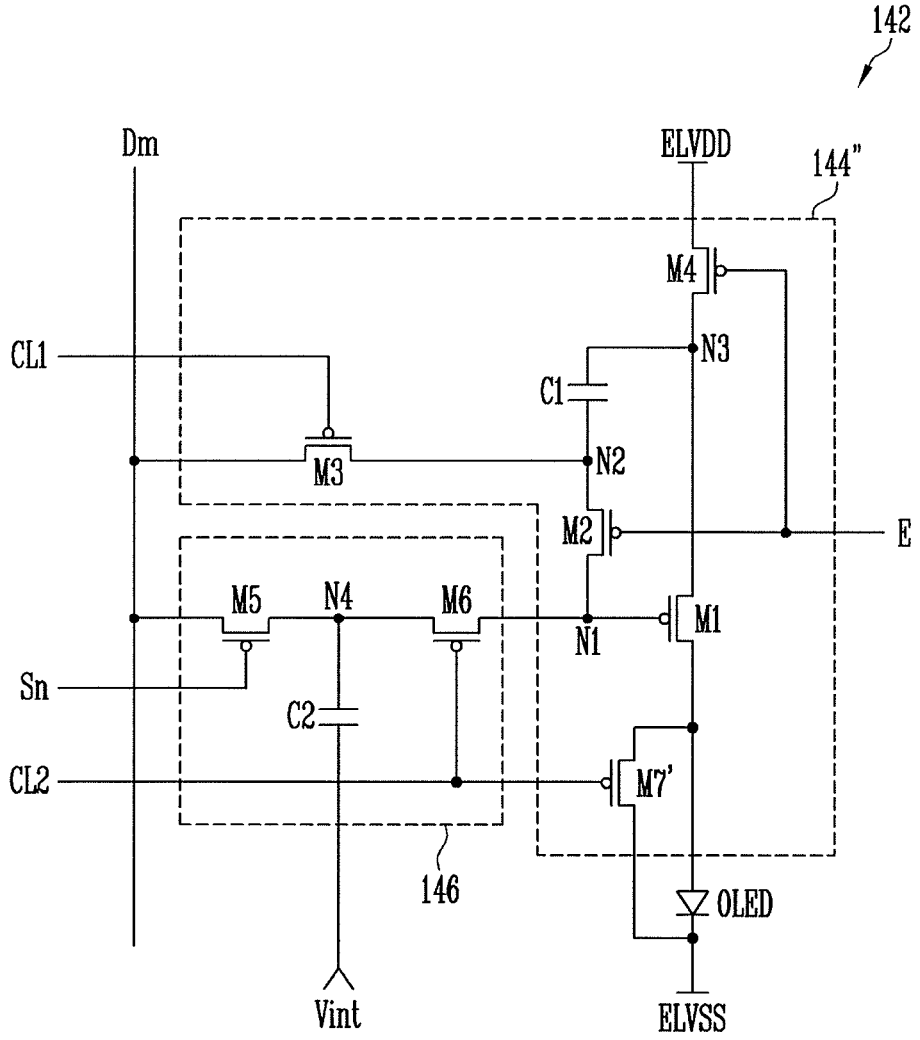
FIG. 6 illustrates a third embodiment of a pixel in FIG. 1.

FIG. 6 illustrates a third embodiment of a pixel 142, which, for example, may be representative of the pixels illustrated in FIG. 1. Referring to FIG. 6, pixel 142 includes an OLED, a pixel circuit 144", and a driver 146.

The pixel circuit 144" includes a seventh transistor M7' coupled between the second power supply ELVSS and an anode electrode of the OLED. The seventh transistor M7' is turned on when the second control signal is supplied to the second control line CL2, to electrically couple the second power supply ELVSS and the anode electrode of the OLED. When the seventh transistor M7' is turned on, the current from the first transistor M1 is supplied to the first power supply ELVSS, not via the OLED but via the seventh transistor M7'.

Thus, a structure and operation processes of the pixel 142 according to the third embodiment are the same as those of the pixel according to the first embodiment illustrated in FIG. 2, except that the current from the first transistor M1 is supplied to the second power supply ELVSS using the seventh transistor M7'. Additionally, the pixel 142 according to the third embodiment may be driven by the driving waveforms of the first embodiment illustrated in FIG. 3 or driving waveforms of a second embodiment illustrated in FIG. 5.

According to one embodiment, for convenience sake, the transistors of the pixel are illustrated as PMOS transistors. However, in other embodiments, the transistors may be formed of NMOS transistors or a combination of NMOS and PMOS transistors.

In addition, according to one embodiment, the OLED may generate light of a specific color to correspond to the amount of current supplied from the driving transistor. However, in other embodiments, the OLED may generate white light to correspond to the amount of current supplied from the driving transistor. In this case, a color image is realized using an additional color filter.

By way of summation and review, an organic light emitting display device includes a plurality of pixels arranged at intersections of a plurality of data lines, scan lines, and power supply lines in a matrix. Each of the pixels is commonly formed of an OLED, at least two transistors including a driving transistor, and at least one capacitor.

Amounts of currents that flow to the OLEDs may change in accordance with deviation in threshold voltages of the driving transistors included in the pixels, so that non-uniformity in display may be caused. For example, in accordance with manufacturing process variables of the driving transistors included in the pixels, characteristics of the driving transistors may be changed, and it may be difficult to manufacture all of the transistors of the organic light emitting display device to have the same characteristics in existing processes. Thus, a deviation in the threshold voltages of the driving transistors may happen.

In order to address the above, a method of adding a compensating circuit formed of a plurality of transistors and capacitors to each of the pixels has been considered. The compensating circuits included in the pixels charge voltages corresponding to the threshold voltages of the driving transistors in one horizontal period so that the deviation in the threshold voltages of the driving transistors is compensated for.

In order to remove a motion blur phenomenon, a method of driving the organic light emitting display device at a driving frequency of 240 Hz or more has been considered. However, when the organic light emitting display device is driven at a high speed of 240 Hz or more, a period of charging the threshold voltages of the driving transistors may be reduced so that it may be difficult to compensate for the threshold voltages of the driving transistors.

In a pixel according to one or more embodiments described herein and an organic light emitting display device using the same, the pixels commonly compensate for the threshold voltages so that a period of compensating for the threshold voltages may be sufficiently secured. Therefore, display quality may be improved.

In addition, according to one or more embodiments, in a period where a second capacitor that primarily charges a data signal supplies a voltage to a gate electrode of a driving transistor, the second capacitor is electrically insulated from a first capacitor coupled to the gate electrode of the driving transistor. Thus, the first capacitor is not charged by a charge sharing method with the second capacitor, so that the capacitance of the second capacitor may be reduced or minimized.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A pixel, comprising:

an organic light emitting diode (OLED) having a cathode electrode coupled to a second power supply;

a pixel circuit including a first capacitor to store a voltage based on a previous data signal and to control an amount of current supplied to the OLED to correspond to the previous data signal; and a driver including a second capacitor to store a voltage based on a present data signal supplied from a data line and to supply the previous data signal to the pixel circuit, wherein:

the first capacitor is electrically insulated from the second capacitor when the voltage based on the present data signal is transferred from the second capacitor to the pixel circuit;

the OLED, pixel circuit, and driver are controlled by signals in a frame that includes first through fourth periods, the second power supply is set to a first voltage in the first and second periods and to a second voltage in the third and fourth periods, and the first voltage is a voltage at which the OLED does not emit light and the second voltage is a voltage at which the OLED emits light.

2. The pixel as claimed in claim 1, wherein in the fourth period:

the pixel circuit is to supply a current to the OLED, and the present data signal is charged in the driver.

3. A pixel, comprising:

an organic light emitting diode (OLED) having a cathode electrode coupled to a second power supply;

a pixel circuit to control an amount of current supplied to the OLED to correspond to a previous data signal; and a driver to store a present data signal supplied from a data line and to supply the previous data signal to the pixel circuit, wherein:

the OLED, pixel circuit, and driver are to be controlled by signals in a frame that includes first through fourth periods, the second power supply is to be set to a first voltage in the first and second periods and to a second voltage in the third and fourth periods, the first voltage is a voltage at which the OLED does not emit light and the second voltage is a voltage at which the OLED emits light, and wherein the pixel circuit includes:

a first transistor having a gate electrode coupled to a first node, a first electrode coupled to a first power supply via a third node, and a second electrode coupled to an anode electrode of the OLED;

a third transistor coupled between a data line and a second node, the third transistor turning on when a first control signal is supplied to a first control line;

a second transistor coupled between the first node and the second node, the second transistor turning off when an emission control signal is supplied to an emission control line;

a first capacitor coupled between the second node and the third node; and a fourth transistor coupled between the first power supply and the third node, the fourth transistor turning off when the emission control signal is supplied.

4. The pixel as claimed in claim 3, wherein:

the third transistor is turned on in the first period to the third period, and the second transistor is turned off in the second period and the third period.

5. The pixel as claimed in claim 3, further comprising:

a seventh transistor coupled between the anode electrode of the OLED and an initializing power supply, the seventh transistor turning on when a second control signal is supplied to a second control line.

6. The pixel as claimed in claim 5, wherein the seventh transistor is turned on in the second period and the third period.

7. The pixel as claimed in claim 5, wherein a voltage of the initializing power supply is set so that a current supplied, via the first transistor, flows when the seventh transistor is turned on.

8. The pixel as claimed in claim 5, wherein the initializing power supply is the second power supply.

9. The pixel as claimed in claim 5, wherein:

the third transistor is turned on in the first period and the second period, and the second transistor is turned off in the second period and the third period.

10. The pixel as claimed in claim 9, wherein the third transistor is turned off before the second power supply at the second voltage is supplied.

11. The pixel as claimed in claim 3, wherein the driver includes:

a fifth transistor coupled between the data line and a fourth node, the fifth transistor turning on when a scan signal is supplied to a scan line;

a sixth transistor coupled between the fourth node and the first node, the sixth transistor turning on when a second control signal is supplied to a second control line; and a second capacitor coupled between the fourth node and an initializing power supply.

12. The pixel as claimed in claim 11, wherein the fifth transistor is turned on at a predetermined point within the fourth period, and the sixth transistor is turned on in the second period and the third period.

13. The pixel as claimed in claim 1, wherein the first voltage is greater than the second voltage.

14. An organic light emitting display device, comprising:

a first power supply to supply a first voltage in a first period and a second period of one frame and to supply a second voltage in a third period and a fourth period of one frame;

a control driver to supply a first control signal to a first control line in the first period and the second period and to supply a second control signal to a second control line in the second period and the third period;

a scan driver to sequentially supply scan signals to scan lines in the fourth period and to supply an emission control signal to an emission control line in the second period and the third period;

a data driver to supply a bias voltage to data lines in the first period, to supply a reference voltage in the second period and the third period, and to supply data signals in the fourth period; and pixels to store present data signals and to emit light to correspond to previous data signals in the fourth period, each of the pixels including a first capacitor electrically insulated from a second capacitor, the first capacitor to store a voltage based on one of the previous data signals and the second capacitor to store one of the present data signals, wherein the first capacitor is to be electrically insulated from the second capacitor when a voltage based on a corresponding one of the present data signals is transferred from the second capacitor to a node coupled to the first capacitor.

15. The display device as claimed in claim 14, wherein:

the previous data signals are data signals of a previous frame, and the present data signals are data signals of a present frame.

16. The display device as claimed in claim 14, wherein the bias voltage is an off-bias voltage at which driving transistors included in the pixels can be turned off.

17. The display device as claimed in claim 14, wherein the reference voltage is a voltage within a voltage range of the data signals.

18. The display device as claimed in claim 14, wherein each pixel includes:

an OLED having a cathode electrode coupled to the first power supply;

a pixel circuit to control an amount of current supplied to the OLED to correspond to the previous data signal; and a driver to store the present data signal and to supply the previous data signal to the pixel circuit.

19. An organic light emitting display device, comprising:

a first power supply to supply a first voltage in a first period and a second period of one frame and to supply a second voltage in a third period and a fourth period of one frame;

a control driver to supply a first control signal to a first control line in the first period and the second period and to supply a second control signal to a second control line in the second period and the third period;

a scan driver to sequentially supply scan signals to scan lines in the fourth period and to supply an emission control signal to an emission control line in the second period and the third period;

a data driver to supply a bias voltage to data lines in the first period, to supply a reference voltage in the second period and the third period, and to supply data signals in the fourth period; and pixels to store present data signals and to emit light to correspond to previous data signals in the fourth period, each of the pixels includes an OLED having a cathode electrode coupled to the first power supply, a pixel circuit to control an amount of current supplied to the OLED to correspond to the previous data signal, and a driver to store the present data signal and to supply the previous data signal to the pixel circuit, wherein the pixel circuit includes:

a first transistor having a gate electrode coupled to a first node, a first electrode coupled to a second power supply via a third node, and a second electrode coupled to an anode electrode of the OLED;

a third transistor coupled between a data line and a second node, the third transistor turning on when the first control signal is supplied;

a second transistor coupled between the first node and the second node, the second transistor turning off when the emission control signal is supplied;

a first capacitor coupled between the first node and the third node; and a fourth transistor coupled between the second power supply and the third node, the fourth transistor turning off when the emission control signal is supplied.

20. The display device as claimed in claim 19, wherein the control driver supplies the first control signal to the first control line in the third period.

21. The display device as claimed in claim 19, further comprising:

a seventh transistor coupled between the anode electrode of the OLED and an initializing power supply, the seventh transistor turning on when the second control signal is supplied.

22. The display device as claimed in claim 21, wherein a voltage of the initializing power supply is set so that a current supplied, via the first transistor, flows when the seventh transistor is turned on.

23. The display device as claimed in claim 21, wherein the initializing power supply is the second power supply.

24. The display device as claimed in claim 19, wherein the driver includes:

a fifth transistor coupled between a data line and a fourth node, the fifth transistor turning on when a scan signal is supplied to a corresponding scan line;

a sixth transistor coupled between the fourth node and the first node, the sixth transistor turned on when the second control signal is supplied; and a second capacitor coupled between the fourth node and an initializing power supply.

25. The display device as claimed in claim 14, wherein the first voltage is greater than the second voltage.

26. The pixel as claimed in claim 1, wherein in the first capacitor and the second capacitor have substantially equal capacitances.

27. The display device as claimed in claim 14, wherein in the first capacitor and the second capacitor have substantially equal capacitances.

* * * * *